United States Patent [19]

Oki et al.

[11] 4,004,183

[45] Jan. 18, 1977

[54] RESISTOR BUILT-IN SPARK PLUG

[75] Inventors: Masami Oki, Nagoya; Masatoshi Suzuki; Yasuo Nakamura, both of Kariya; Osami Kamigaito; Hideyuki Masaki, both of Nagoya, all of Japan

[73] Assignees: Nippondenso Co., Ltd.; Kabushiki Kaisha Toyota Chuo Kenkyusho, both of Japan

[22] Filed: Apr. 30, 1975

[21] Appl. No.: 573,326

[30] Foreign Application Priority Data

May 10, 1974 Japan ..... 49-52710

[52] U.S. Cl. ..... 315/58; 174/152 S; 252/518; 338/66

[51] Int. Cl.[2] ..... H01T 1/16

[58] Field of Search ..... 315/58; 338/66; 174/152 S; 252/518

[56] References Cited

UNITED STATES PATENTS

| | | | |
|---|---|---|---|
| 2,371,211 | 3/1945 | Barrington | 315/58 |
| 2,459,282 | 1/1949 | McDougal et al. | 315/58 |
| 2,864,884 | 12/1958 | Counts et al. | 315/58 |
| 3,452,235 | 6/1969 | Hallauer et al. | 315/58 |

*Primary Examiner*—John Kominski
*Attorney, Agent, or Firm*—Cushman, Darby & Cushman

[57] ABSTRACT

A resistor built-in spark plug comprising an insulator formed therein with an axially extending bore, a terminal nut fitted in an upper end portion of the bore, a center electrode fitted in a lower end portion of the bore, a resistor arranged in a central portion of the bore, one copper-glass electrode interposed between the resistor and the terminal nut, and another copper-glass electrode interposed between the resistor and the center electrode, such resistor being made by firing (calcining) and solidifying a resistor powder mixture consisting of 30 to 10 volume % of a principal resistor component containing tin oxide, 35 to 85 volume % of insulating ceramic filler powder of a higher electric resistivity than the principal resistor component which is selected from the group consisting of quartz glass, alumina, zircon, zirconia, silica ($SiO_2$) and $\beta$-spodumene, and 35 to 5 volume % of glass powder having a softening temperature in a range between 300° and 600° C. One or both of the two copper-glass electrodes may consist of two electrode layers, one copper-glass layer maintained in contact wth the resistor and having a higher copper content than the other copper-glass electrode layer.

3 Claims, 6 Drawing Figures

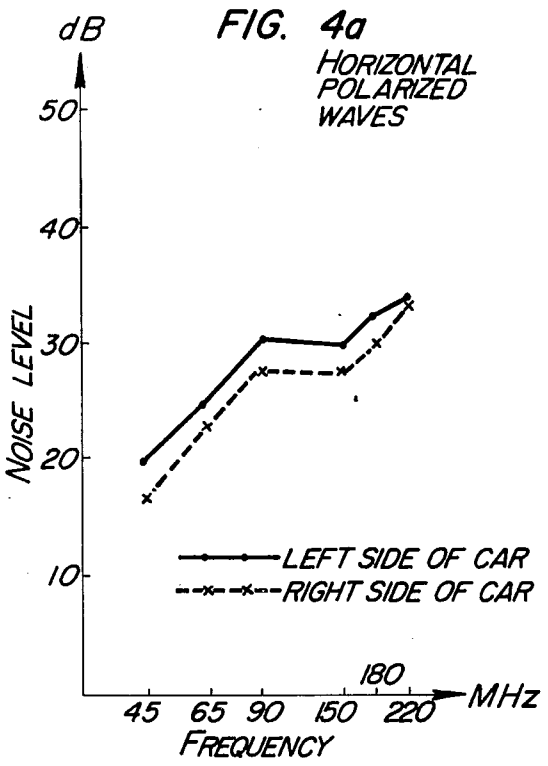
FIG. 4a HORIZONTAL POLARIZED WAVES
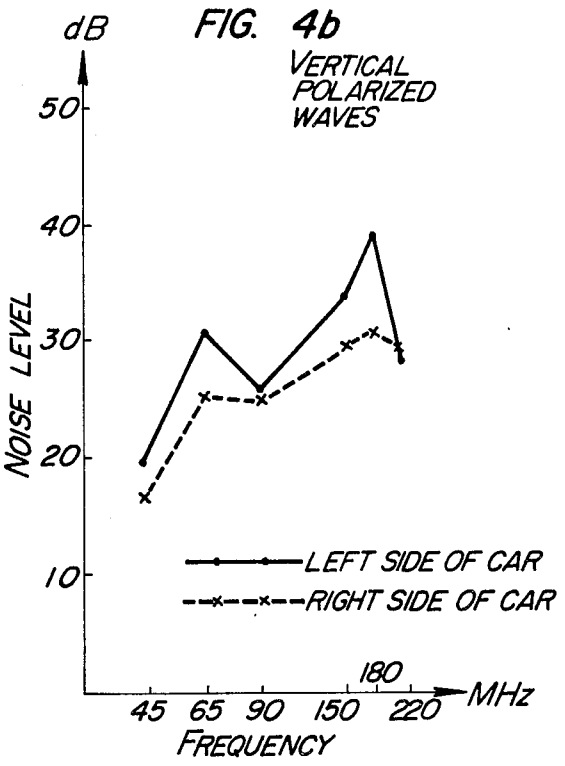
FIG. 4b VERTICAL POLARIZED WAVES

RESISTOR BUILT-IN SPARK PLUG

This invention relates to improvements in or relating to resistor built-in spark plugs, and more particularly it is concerned with an ingition plug of the above type wherein interference with radio wave communication caused by radio frequency noise produced by the high voltage ignition circuit for an internal combustion engine can be minimized.

It has hitherto been emphatically demanded to provide means for preventing interference with radio wave communication caused by the electromagnetic waves produced by car-ignition systems of the spark plug type. To obviate this disadvantage proposals have been made to add a resistor in the electric circuits for ignition plugs and some of them have already been put into practice. One of such proposals teaches the provision of a resistor in the bore of an insulator of a spark ignition plug. The results achieved by this type of improvement in eliminating the noise produced by car-ignition systems have not, however, been satisfactory. Moreover, this type of resistor built-in ignition plug has the additional disadvantage of its resistivity fluctuation greatly depending on the amount of glass added to the resistor material, since the resistor is provided in the bore of the insulator of the spark plug.

Accordingly, it is a main object of the present invention to solve the above-said problem by using a principal resistor component containing tin oxide as a principal material for the resistor according to the present invention, said principal resistor component being described in the specification of Japanese Pat. Nos. 95439/72, 109724/72, 112363/72 and 115931/72. The resistor made from the principal resistor component containing tin oxide as its principal ingredient gives a satisfactory resistivity in a range between several KΩ and several tens KΩ, said values of the resistivity being necessary for the resistor to be practical in use. The resistivity provided by this type of resistor is stable and does not show so great fluctuations in value even if there are variations in the amount of glass added to the principal resistor component containing tin oxide.

Meanwhile we have conducted a series of experimental tests in order to provide improvements in known resistor built-in spark plugs in view of the fact that these ignition plugs have little, if it may have any, effect in preventing noise production. As the result of the experiments, it has been found that, by zigzagging the path of an electric current through the resistor in a portion thereof between the terminal nut and the center electrode, it is possible to reduce the noise which interferes with radio wave communication. We presume that this reduction can be explained as follows: the electric current flowing through the zigzag path in the resistor would induce an inductive reactance component to the resistor. The presence of the inductive reactance component in the resistor would provide a high resistance value for a high frequency component, so that the resistor would become highly effective resistance to prevent the electromagnetic wave of high frequency which would be a noise in radio wave communication. This would cause the noise to be damped in the resistor, thereby lowering the noise level in the radio waves.

We have found that zigzagging of the path of the electric current through the resistor can be realized by adding to the resistor material a material which has a considerably higher value of electric resistance than the principal resistor component of the resistor. That is, if a material having a very high value of electric resistance is used as a component of the resistor, it would be possible to zigzag the path of the electric current through the resistor, as the electric current would not flow through this material. It has been found that an insulating ceramic filler can serve this purpose when it is used as a material of high electric resistivity.

Accordingly, this invention has the provision of a resistor built-in spark plug wherein a resistor powder mixture consisting of 30 to 10 volume % of a principal resistor component containing tin oxide, 35 to 5 volume % of glass powder having a softening temperature in a range between 300° and 600° C, and 35 to 85 volume % of insulating ceramic filler powder is solidified and arranged in a bore formed in the insulator of the spark plug, and wherein a mixture of copper powder and glass powder is solidified and provided between the solidified portion resistor powder mixture and the terminal nut and between the solidified portion of resistor powder mixture and the center electrode, whereby the resistor built-in spark plug according to the invention can be made to have a superior property of noise prevention among all the properties which are desired to be superior for a resistor built-in spark plugs.

In the present invention, what is referred as an insulating ceramic filler (hereinafter referred to as a filler) is such a material that has a relatively higher electric resistivity than the principal resistor component as aforesaid, said filler being, for example, quartz glass, alumina ($Al_2O_3$), zircon ($ZrO_2.SiO_2$), zirconia ($ZrO_2$), silica ($SiO_2$), β-spodumene ($Li_2O.Al_2O_3.3.5 - 8\ SiO_2$) or mixture thereof. Of these materials, quartz glass has a softening temperature of about 1650° C and is distinguished from the glass powder having a softening temperature in a range between 300° and 600° C.

In the present invention, what is referred as a principal resistor component containing tin oxide included one or two materials selected from the group consisting of carbon powder, antimony oxide, tantalum oxide, aluminum phosphate and an organic binder, in addition to the tin oxide which is the principal resistor component.

According to the invention, the resistor powder mixture comprises a principal resistor component containing tin oxide, glass powder and a filler. More specifically, the resistor powder mixture consists of 35 to 5 volume % of glass powder, 35 to 85 volume % of a filler and the balance of 30 to 10 volume % of the principal resistor component containing tin oxide. When the glass powder is below 5 volume % and the filler is over 85 volume %, no problem is raised in preventing noise waves. However, difficulty is experienced in the production of the resistor built-in spark plugs. That is, in producing them, it will become difficult to bond to the wall of the bore in the insulator the resistor powder mixture which is filled in the bore in the insulator or to compress the same in the bore. If an excessively high pressure is applied to the terminal nut or if the temperature is elevated in producing the plugs, then the aforementioned difficulty may be obviated, but this would destroy the insulator or cause marked oxidation of the terminal nut, thereby making it impossible to mass-produce the resistor built-in spark plugs. On the other hand, in case that the glass powder is above 35 volume % and the filler is below 35 volume %, it would be little effective for preventing noise wave.

The amount of the principal resistor component containing tin oxide may vary depending on the amount of glass powder and the amount of filler.

The softening temperature of the glass powder used in the invention is between 300° and 600° C. When the ignition plug is actuated, the temperature of the plug itself is raised much higher than 250° C. Thus, if the glass used were to have a softening temperature of about 250° C, the resistor in the bore formed in the insulator would be softened. Therefore, the lower limit of the softening temperature of the glass powder should be set at 300° C to be on the safe side. On the other hand, if the temperature of the glass used is above 600° C, there will also be disadvantages. The resistor containing such glass powder would exhibit a high noise level and consequently has little effect in preventing interference in radio wave communication caused by the ignition systems. Moreover, it is impossible to weld the resistor to the wall of the bore in the insulator by hot pressing in a temperature range in that range the center electrode is prevented from oxidation. If hot pressing is carried out at a temperature above such temperature range, then the terminal nut and center electrode will be oxidized, making the products unfit for use.

Additional and other objects and features of the invention will become evident from the description set forth hereinafter when considered in conjunction with the accompanying drawings, in which:

FIG. 4(*a*) is a characteristic view showing the relation between the frequencies of the horizontal polarized waves and noise levels in explanation of the invention;

FIG. 4(*b*) is a characteristic curves showing the relation between the frequencies of the vertical polarized waves and noise levels in explanation of the invention.

Figure 1:
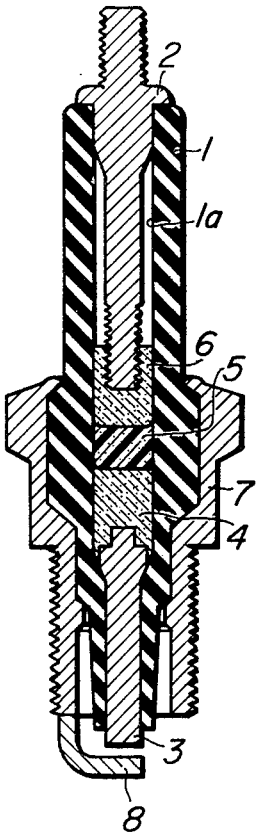
FIG. 1 is a vertical sectional view of the resistor built-in spark plug according to one embodiment of the invention.
Figure 2:
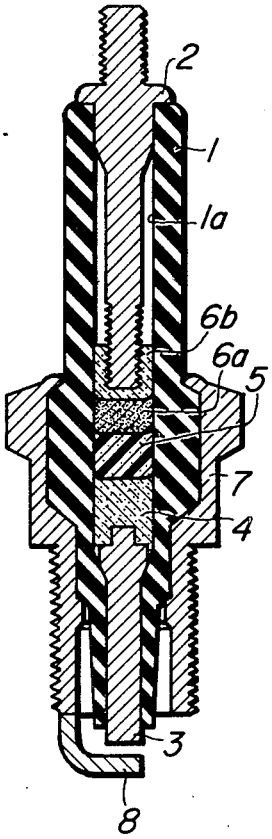
FIG. 2 is a vertical sectional view of a modified form of the resistor built-in spark plug shown in FIG. 1.
Figure 3:
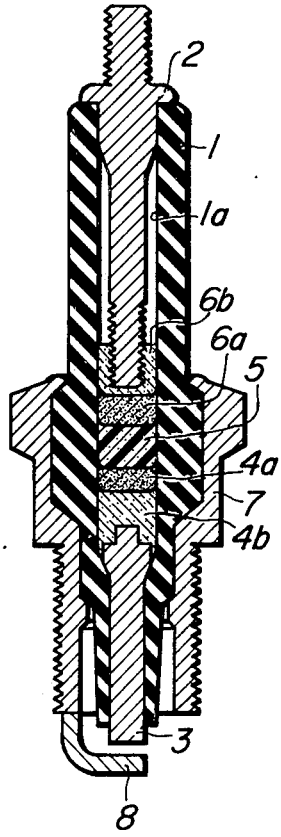
FIG. 3 is a vertical sectional view of another modified form of the resistor built-in spark plug shown in FIG. 1.

In FIG. 1 to FIG. 3, like reference characters designate like or corresponding part throughout. In FIG. 1, 1 designates an insulator made of alumina of high purity or the like, and 2 a terminal nut fitted in an upper portion of an axially extending bore 1*a* formed in the insulator 1. 3 refers to a center electrode which is fitted in a lower end portion of the axially extending bore 1*a* formed in the insulator 1. 4 designates a copper-glass electrode made by firing a mixture of glass powder and copper powder and forming the mixture into a bonded mass and disposed on the center electrode. 5 refers to a resistor made by calcining the resistor powder mixture of the aforesaid composition and solidifying the mixture. 6 is another copper-glass electrode of the same composition as the copper-glass electrode 4 and is maintained in contact with the terminal nut 2. 7 refers to a housing made of metal, sorrounding outer periphery of the insulator 1 and carrying at one end thereof an earth electrode 8 disposed in spaced and opposed relation to the center electrode 3.

In FIG. 2 and FIG. 3, show modifications of the resistor built-in spark plug in FIG. 1. In the modifications shown, the copper-glass electrode 4 and/or the copper-glass electrode 6 are divided into two layers 4*a* and 4*b* and/or 6*a* and 6*b*. The copper-glass electrode layers 6*a* and 4*a* have a higher copper content than the copper-glass electrode layers 6*b* and 4*b*, while the copper-glass layers 6*b* and 4*b* have the same copper content as the copper-glass electrodes 6 and 4.

It is to be noted that, although these embodiments are preferred embodiments of the invention, the invention is not limited to them and they are only shown and described by way of example.

As shown in Table 1, various types, No. 1 to No. 22, of glass powder are provided for, having a grain size capable of passing through 200 mesh-screen. The principal resistor component containing tin oxide (hereinafter referred to as the principal resistor component) is prepared as follows: 3 weight % of antimony oxide and 10 weight % of tantalum oxide were added to tin oxide, and the mixture is calcined at 1200° C and solidified. The solidified material is formerd into particulate form. Quartz glass powder, zirconia powder, zircon powder, silica powder, alumina powder and $\beta$-spodumene powder are prepared as filler powder (of a size capable of passing 80 mesh-screen). Each type of glass powder, each filler powder and the principal resistor component are weighed and put together in suitable proportions, and the mixtures are thoroughly mixed by means of a ball mill. On the other hand, 50 weight % of copper powder (of a size capable of passing 200 mesh) and 50 weight % of each of the various types of glass powder shown in FIG. 1 are mixed to produce a mixture powder (hereinafter referred to 50-copper glass powder).

In addition, the insulator 1 (its axially extending bore 1*a* havin a diameter of 4.8 mm), center electrode 3 and terminal nut 2 shown in FIG. 1 are prepared.

The process of producing various samples of the resistor built-in spark plug shown in FIG. 1 will now be described. The center electrode 3 is first inserted into the lower end portion of the axially extending bore 1*a* formed in the insulator 1, and 0.2 gr. of the 50-copper glass powder is poured into the bore 1*a*. Then a pressure of about 50 kg/cm$^2$ is applied by means of a press to the 50-copper glass powder to flatten the upper surface of the mixture. About 0.5 gr. of a mixture of the principal resistor component filler and glass powder is poured into the bore 1*a*, and pressure is applied to flatten the upper surface of the mixture. Thereafter about 0.3 gr. of the 50-copper glass powder is further poured into the bore 1*a*, the terminal nut 2 is inserted into the upper end portion of the bore 1*a*, and pressure is applied to the terminal nut 2.

The insulator 1 is entirely inserted into an electric resistance furnace maintained at a temperature of 850° C, allowed to stand for about 30 minutes, and withdrawn from the furnace. A pressure of about 50 kg/cm$^2$ is applied by means of a press, to the terminal nut 2, so that particles of various materials filled in the bore 1*a* can be compressed and made to adhere to one another and to the inner wall of the bore 1*a*. By this final step, the 50-copper glass powder on the center electrode 3 is formed into the copper-glass electrode 4, the mixture of the principal resistor component filler and glass powder is formed into the resistor 5, and the 50-copper glass powder in contact with the terminal nut 2 is formed into the copper-glass electrode 6.

After the insulator 1 has cooled, the housing 7 carrying the earth electrode 8 is fitted over the outer periphery of the insulator 1, thereby the insulator built-in spark plug is completed. In this embodiment, the amount of the principal resistor component is so selected that the resistor built-in spark plug is constructed as aformentioned is adapted to have a resistance value of 5 KΩ±1.5 KΩ said resistance value being one of those specified in the JIS standards for resistor built-in spark plugs.

100 samples in each kind of the resistor built-in spark plug were manufactured for one type of glass powder shown in Table 1 and for one type of filler by the aforementioned process. The samples manufactured in this way were tested for noise level. Commercially available resistor built-in spark plugs of the prior art, were also tested for noise level. The results of tests are shown in Table 2—1 and Table 2—2.

Table 1

| Glass type No. | Components and properties of various types of glass: Composition $Na_2O$ | $K_2O$ | CaO | MgO | $B_2O_3$ | $Al_2O_3$ | $SiO_2$ | PbO | $TiO_2$ | ZnO | $P_2O_5$ | Thermal expansion ($\times 10^{-6}$/C) | Softening temperature (° C) |
|---|---|---|---|---|---|---|---|---|---|---|---|---|---|
| 1 | 7 | | | | 2.3 | 16 | 64 | | | | | 4.3 | 590 |
| 2 | 6 | 2.5 | 3.5 | | 13 | 16 | 59 | | | | | 7.4 | 570 |
| 3 | 9 | | | | | 5 | 72 | | | | | 6.0 | 760 |
| 4 | | | | | 17.3 | | | 82.7 | | | | 11.3 | 360 |
| 5 | | | | | 11 | 11 | 3 | 75 | | | | 8.3 | 440 |
| 6 | | | | | 30 | | | 70 | | | | 8.8 | 448 |
| 7 | | | | | 31.7 | | | 68.3 | | | | 8.6 | 451 |
| 8 | | | | | 34.9 | | | 65.1 | | | | 7.9 | 493 |
| 9 | | | | | 44.6 | | | 55.4 | | | | 6.3 | 540 |
| 10 | | | | | 75 | | | 25.0 | | | | 5.7 | 705 |
| 11 | 9.5 | | | | 39.2 | | 43.2 | | 8.1 | | | 6.6 | 730 |
| 12 | 28.0 | | | | 41.9 | | 18.1 | | 12.0 | | | 13.2 | 580 |
| 13 | 18.4 | | | | 3.8 | | 34.2 | | 33.6 | | | 10.3 | 700 |
| 14 | 39 | | | | 32 | | 14 | | 15 | | | 14.0 | 500 |
| 15 | | | | $V_2O_5$ 10 | 30 | | | | | 60 | | 5.2 | 440 |
| 16 | | | | $V_2O_5$ 30 | 20 | | | | | 50 | | 5.1 | 480 |
| 17 | | | | 10 | 50 | | | | | 40 | | 5.2 | 576 |
| 18 | | | | | 45 | | | | | 55 | | 4.6 | 620 |
| 19 | 14 | | | | 14 | 15.5 | | | | | 33.5 | 12.4 | 360 |
| 20 | | | 10 | 4 | 4 | 12 | | | | | 70 | 13.5 | 400 |
| 21 | | | 10 | 10 | 30 | 10 | | | | | 40 | 8.0 | 530 |
| 22 | | | | 13.6 | 38.1 | 21.7 | | | | | 21.6 | 6.1 | 700 |

Table 2-1

| Sample No. | Resistor: Glass No. of Table 1 | Proportion of glass (volume %) | Types of filler | Proportion of filler (volume %) | Noise level (≈) × (dB) |
|---|---|---|---|---|---|
| 1 | 5 | 45 | Quartz glass | 0 | 34.2 |
| 2 | 5 | 40 | " | 10 | 34.6 |
| 3 | 5 | 30 | " | 30 | 30.6 |
| 4 | 5 | 20 | " | 50 | 30.3 |
| 5 | 5 | 10 | " | 70 | 29.1 |
| 6 | 5 | 5 | " | 80 | 28.3 |
| 7 | 5 | 20 | $ZrO_2 . SiO_2$ | 50 | 29.6 |
| 8 | 5 | 20 | β-spodumene | 50 | 30.1 |
| 9 | 5 | 20 | $ZrO_2$ | 50 | 30.3 |
| 10 | 5 | 20 | $Al_2O_3$ | 50 | 32.0 |
| 11 | 5 | 20 | $SiO_2$ | 50 | 29.6 |
| 12 | 2 | 40 | " | 10 | 33.4 |
| 13 | 2 | 30 | " | 30 | 30.2 |
| 14 | 1 | 30 | $SiO_2$ | 30 | 29.8 |
| 14' | 1 | 20 | " | 50 | 29.8 |
| 15 | 4 | 25 | " | 40 | 30.2 |
| 15' | 3 | 20 | " | 50 | 33.2 |
| 16 | 6 | 20 | " | 50 | 29.6 |
| 17 | 7 | 20 | " | 50 | 29.8 |

Table 2-2

| Sample No. | Resistor: Glass No. of Table 1 | Proportion of glass (volume %) | Types of filler | Proportion of filler (volume %) | Noise level (≈) × (dB) |
|---|---|---|---|---|---|
| 18 | 8 | 20 | Quartz glass | 50 | 30.3 |
| 19 | 9 | " | " | " | 28.6 |
| 20 | 10 | " | " | " | 32.4 |
| 21 | 11 | " | " | " | 33.3 |
| 22 | 12 | " | " | " | 30.4 |
| 23 | 13 | " | " | " | 34.5 |
| 24 | 14 | " | " | " | 30.2 |
| 25 | 15 | " | " | " | 30.4 |
| 26 | 16 | " | " | " | 30.5 |
| 27 | 17 | " | " | " | 30.2 |
| 28 | 18 | " | " | " | 33.4 |

Table 2-2-continued

| Sample No. | Resistor: Glass No. of Table 1 | Resistor: Proportion of glass (volume %) | Resistor: Types of filler | Resistor: Proportion of filler (volume %) | Noise level (≈) × (dB) |
|---|---|---|---|---|---|
| 29 | 19 | " | " | " | 30.3 |
| 30 | 20 | 20 | Quartz glass | 50 | 29.8 |
| 31 | 21 | " | " | " | 30.6 |
| 32 | 22 | " | " | " | 33.4 |
| 33 | — | — | — | — | 34.6 |
| 34 | — | — | — | — | 34.3 |
| 35 | — | — | — | — | 33.8 |
| 36 | — | — | — | — | 33.6 |
| 37 | — | — | — | — | 32.5 |
| 38 | — | — | — | — | 32.4 |

The noise level was determined by using the C.I.S.P.R. testing method adopted by Comite International Spacial Des Perturbations Radio-electriques (International Special Committee on Radio Interference). The C.I.S.P.R. testing method consists of erecting an aerial of 3 meters hight on either side of a motor vehicle in a position spaced apart from the vehicle a distance of about 10 meters, and measuring the noise of electromagnetic wave with dividing it into horizontal polarized waves and vertical polarized waves. The noise level is determined on the horizontal polarized waves and the vertical polarized waves, respectively.

The noise level "$\underset{\bar{X}}{\approx}$" (dB) was determined as follows: the noise level was measured on both sides of a motor vehicle equipped with a 4-cycle, 4-cylinder engine of 2,000 cc. for each sample of resistor built-in spark plug by using the C.I.S.P.R. method. The results of the tests for one sample are shown in FIG. 4(*a*) and FIG. 4(*b*) wherein the frequencies of noise (MHz) produced by the spark plug are set forth along the X-axis in logarithmic scale, while the values of noise level (dB) are set forth along the Y-axis in uniform scale. FIG. 4(*a*) shows the results on the horizontal polarized waves, while FIG. 4(*b*) shows the results on the vertical polarized waves. The mean value in the sum total of the noise levels of the horizontal polarized waves shown in FIG. 4(*a* ) or the noise levels of the vertical polarized waves shown in FIG. 4(*b*) was designated as"$\underset{\bar{X}}{\approx}$".

As can be seen in Table 2—1 and Table 2—2, it has been found that the smaller the proportion of glass in the resistor and the greater the proportion of filler therein are, the lower the noise level $\underset{\bar{X}}{\approx}$ of the ignition plug comes to result. This tendency is not substantially affected with the type of glass or the type of filler used. It will be seen that sample No. 6 which consists of 5 volume % of glass and 80 volume % of filler has the lowest noise level. Understanding from Table 2—1 and Table 2—2, the noise level $\underset{\bar{X}}{\approx}$ becomes much higher when the proportion of glass is greater than 30 volume % and the proportion of filler is smaller than 30 volume %. In such a case, the resistor built-in spark plug has less effect to prevent noise production. It is not clear which kind of factors are responsible for this phenomenon. A reduction in the proportion of glass might lower the dielectric constant of the glass as a resistor material. An increase in the proportion of filler might cause an increase in the circuit constant or the effective value of resistance. Samples Nos. 33 to 38 which are commercially available resistor built-in spark plugs of the prior art each exhibit a high noise level which is in a range between 32 and 34 dB and which is of the same order as the noise levels shown by samples No. 1 and No. 2. It will be estimated that the resistor built-in spark plugs of the prior art have little effect in preventing noise production.

A study of the resistor built-in spark plugs of the prior art used in the experiments as samples No. 33 to No. 38 has revealed that they are similar in construction to the resistor built-in spark plug shown in FIG. 1 and that they contain resistors each consisting of carbon, glass and a certain proportion of insulating ceramic filler ($ZrO_2.SiO_2$). It will be seen that almost all other samples each have a noise level which is about 29±1 dB and which is lower than the noise levels shown by samples Nos. 1, 2, 3, 12 and 33 to 38. This shows that the resistor built-in spark plug according to the invention is highly effective to prevent noise. It will be noted that sample No. 10 has apparently a noise level of 32.0 dB, so that this sample will be classified as having little effect to prevent noise. However, a review of the results of tests conducted on this sample in accordance with the method shown in FIG. 4(*a* ) and FIG. 4(*b*) shows that its average noise level has become high because of the fact that had an extremely high value both in horizontal and vertical polarized waves is happendly recorded in a frequency band.

From the foregoing description and in view of the noise levels shown in Table 2—1 and Table 2—2, it will be appreciated that the resistor built-in spark plug will have super effect to prevent noise if the resistor thereof consists of 5 to 30 volume % of glass, 80 to 30 volume % of a filler and the balance of the principal resistor component. Based on the results of tests shown in Table 2—1 and Table 2—2, a study was conducted to determine the proportions of glass and filler which would enable the resistor to show a maximum effect to prevent noise as well as the spark plug to be produced without any trouble. The results obtained show that the resistor consisting of 5 to 35 volume % of glass, 85 volume % of a filler and 10 to 30 volume % of the principal resistor component will meet these requirements. It has been found that, when the proportion of glass is below 5 volume %, and the proportion of the filler is above 85 volume %, the mass-production of plugs is substantially impossible to carry out because, due to the lack of a sufficient amount of glass, an excessively high pressure must be applied or the temperature must be raised to a much higher level in production and this will destroy the insulators, although the aforesaid proportions of the glass and filler would seem to have excellent effect in preventing noise production.

On the other hand, it has been ascertained that, when the proportion of the glass is above 35 volume % and the proportion of the filler is below 35 volume %, the resistor built-in spark plug exhibits marked increase in noise level, so that the resistor has very little effect to prevent noise production. Furthermore, as can be seen in Table 2—1 and Table 2—2, there are some samples which show a high noise level, in spite of the fact that the proportions of the glass and filler are in the aforesaid ranges. More specifically, samples Nos. 15', 20, 21, 23, 28 and 32 can be classified into this group. A study of this group of samples shows that, as shown in Table 1, the glass of these samples has a high softening temperature, the softening temperatures of these glasses being 760° C, 705° C, 730° C, 700° C, 620° C and 700° C respectively. It is presumed that each of these samples show a high noise level, because the high softening temperature of the glass would prevent the glass itself fluidifying enough to enable the resistor to weld to the inner wall defining the bore in the insulator when hot pressing is performed, so that crack formation would occur in the resistor and would bring about a variation in the value of resistance said variation causing an increase in noise level when the spark plug is in service. Understanding from these observations and the informations shown in Table 2—1 and Table 2—2, the softening temperature of the glass should be below 600° C. However, in actual practice, the temperature of the ignition plug itself will be about 250° C in use, so that the lower limit of the softening temperature will have to be 250° C. It would, however, be advisable to set the lower limit of the softening temperature at 300° C taking a safety's sake into consideration. Thus, according to the invention, preferably, the softening temperature of the glass should be in a range between 300° and 600° C.

The ignition plugs having built therein samples Nos. 1 to 32 of the resistors shown in Table 2—1 and Table 2—2 have been found to have a resistance value of 5 KΩ±1.5 KΩ. Resistor built-in spark plugs having higher resistance values, e.g. 10 KΩ±3 KΩ or 15 KΩ±4.5 KΩ, could be produced by adjusting the proportion of tin oxide in the principal resistor component, maintaining the proportions of the filler and glass constant. The proportion of the glass, the proportion of the filler, the proportion of the principal resistor component and the softening temperature of the glass are, of course, maintained in the aforesaid ranges to produce resistors of higher resistance values than 5 KΩ±1.5 KΩ.

Figure 5:
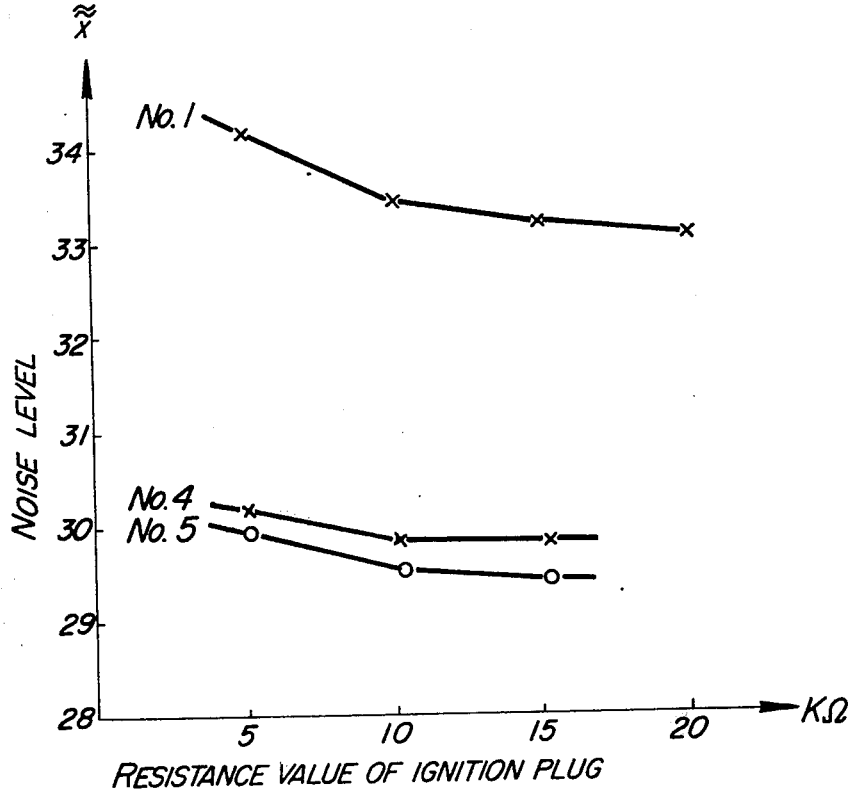
FIG. 5 is a characteristic curves showing the relation between the values of resistance of the spark plugs and noise levels in explanation of the invention.

We have carried out a study on the influences of the resistance values on the noise levels. The results of the study are shown in FIG. 5 wherein the resistance values (KΩ) of the ignition plugs are set forth along the X-axis in uniform scale while the noise levels ($\frac{\approx}{X}$) are set forth along the Y-axis also in uniform scale. Curves 1, 4 and 5 in the figure represent the results obtained with the samples of the same number or samples Nos. 1, 4 and 5 shown in Table 2—1. As can be seen in FIG. 5, the higher the value of resistance becomes, the lower the noise level come to results, so that a higher resistance value has effect to prevent noise wave. However, it should be noted that little change occurs in the noise level when the value of resistance is above 10 KΩ. It will be seen in the figure that samples Nos. 4 and 5 superior to sample No. 1 in all the values of resistance to prevent noise wave. It will thus be seen that the results of the experiments show the influence of the proportion of the filler on the noise level.

Aforesaid description refers to the resistor built-in spark plug constructed as shown in FIG. 1. It has been ascertained that, when the resistor built-in spark plugs of the construction shown in FIG. 2 and FIG. 3, are used, the same result as obtained with the plug shown in FIG. 1 can be obtained, as far as the materials of the resistors are similar to those of the resistor of FIG. 1 and the materials are in the same conditions.

As set forth in detail hereinabove, a principal resistor component containing tin oxide is used as a material for the resistor in the present invention. This enables to produce a resistor built-in spark plug of any desirable resistance value.

Specifically, according to the invention, the resistor consists of 10 to 30 volume % of the principal resistor component containing tin oxide, 5 to 35 volume % of glass powder having a softening temperature in a range between 300° and 600° C, and 85 to 35 volume % of insulating ceramic filler powder to be adapted to lower noise level. Thus the resistor built-in spark plug according to the invention is lower in noise level than resistor built-in spark plugs of the prior art and has higher effect to prevent noise which would result in interference to radio wave communication.

What we claim is:

1. A resistor built-in spark plug comprising:

an insulator provided with an axially extending bore;

a terminal nut fitted in the upper end portion of said bore;

a center electrode fitted in the lower end portion of said bore;

a resistor arranged in the central portion of said bore;

copper glass electrode layers respectively interposed between said resistor and said terminal nut, as well as between said resistor and said center electrode, wherein said resistor is made of a calcined and solidified resistor powder mixture which consists of 30 to 10 volume % of a principal resistor component powder containing tin oxide, 35 to 85 volume % of an insulating ceramic filler powder having a relatively high resistivity as compared with said principal resistor component powder, and 35 to 5 volume % of a glass powder having a softening temperature in range between 300° to 600° C; and between said resistor and said copper glass electrode layer contacting said terminal nut a copper glass electrode layer having a higher content of copper than that of said copper glass electrode layer contacting said terminal, and between said resistor and the other said copper glass electrode layer contacting said center electrode a copper glass electrode layer also having a higher content of copper than that of said copper glass electrode layer contacting said center electrode.

2. A resistor built-in spark plug according to claim 1, wherein said insulating ceramic filler powder is a member selected from the group consisting of quartz glass, alumina, zircon, zirconia, silica, β-spodumene and mixtures thereof.

3. A resistor built-in spark plug according to claim 1, wherein said principal resistor component powder further contains antimony oxide and tantalum oxide.

* * * * *